United States Patent [19]

Bennett

[11] Patent Number: 4,570,465

[45] Date of Patent: Feb. 18, 1986

[54] PLURAL BRANCH LOCKING CABLE

[76] Inventor: Anthony B. Bennett, 401 E. 74th St., New York, N.Y. 10021

[21] Appl. No.: 610,245

[22] Filed: May 14, 1984

[51] Int. Cl.[4] ..... E05B 73/00

[52] U.S. Cl. ..... 70/18; 70/58; 70/232; 70/371

[58] Field of Search ..... 70/58, 59, 18, 57, 14, 70/15, 30, 49, 60, 61, 62, 229, 232, 371

[56] References Cited

U.S. PATENT DOCUMENTS

| | | | |
|---|---|---|---|
| 3,101,695 | 8/1963 | Honeyman | 70/58 |
| 3,564,879 | 2/1971 | Bennett | 70/58 |
| 3,886,770 | 6/1975 | Smith | 70/18 |
| 4,055,973 | 11/1977 | Best | 70/58 |
| 4,212,175 | 7/1980 | Zakow | 70/58 |
| 4,325,238 | 4/1982 | Scherbing | 70/18 |

*Primary Examiner*—Robert L. Wolfe

*Attorney, Agent, or Firm*—Ostrolenk, Faber, Gerb & Soffen

[57] ABSTRACT

Plural branch locking cable comprising main cable with distal end including cable stop for being held inside shell of article being secured, and crimp element on cable at exterior of shell of article being secured. Plural auxiliary cables having distal ends fitted with respective cable stops and each secured to respective article. Proximal end of each auxiliary cable held in a freely slidable, rotatable manner to main cable. Lock on proximal end of main cable for secure attachment to fixed object.

7 Claims, 6 Drawing Figures

FIG. 4.
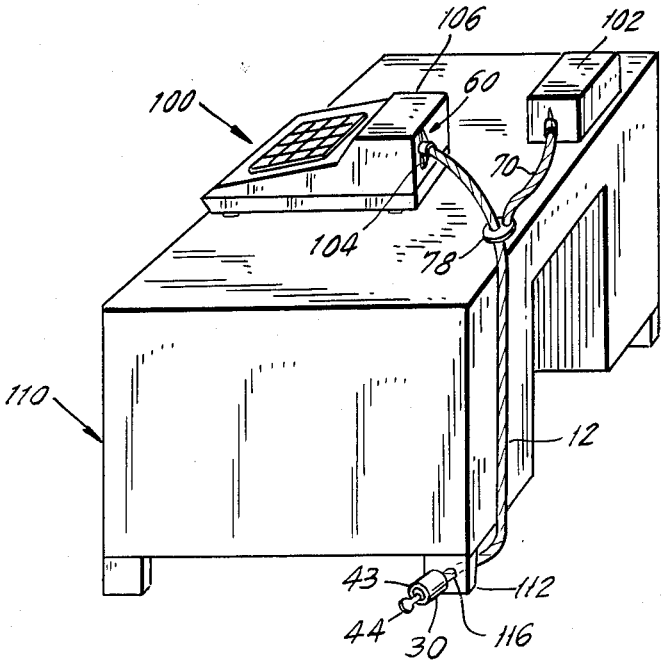
FIG. 5.
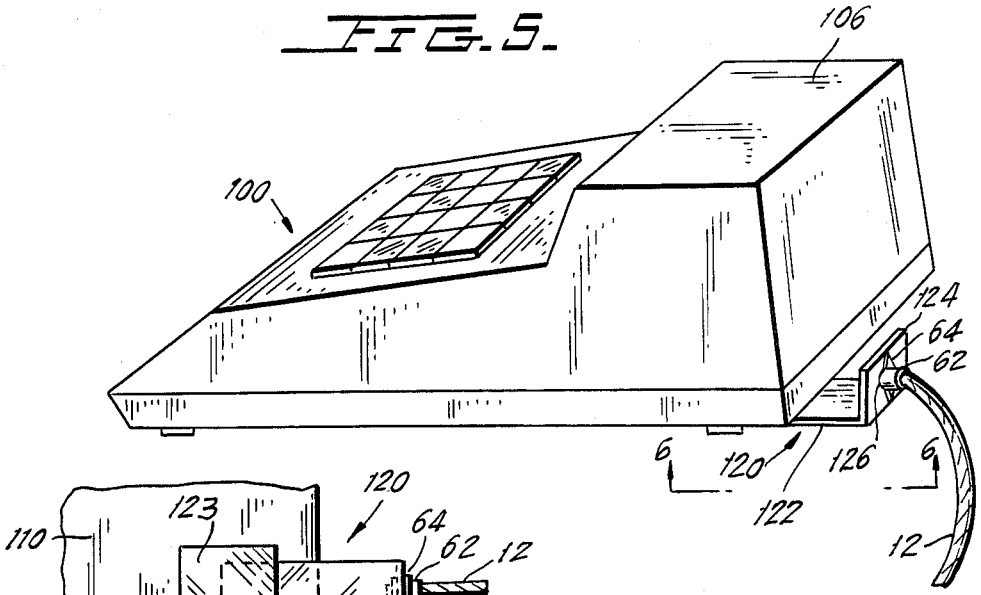
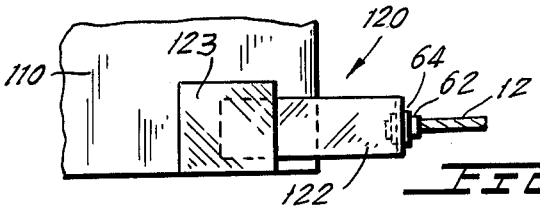
FIG. 6.

PLURAL BRANCH LOCKING CABLE

BACKGROUND OF THE INVENTION

The present invention relates to a cable, or the like, for locking a plurality of portable articles to a stationary object. The invention has particular utility in the environment of a business office for securing articles of business equipment against undesired removal, although the invention is not limited to use in such environment.

Office equipment, such as typewriters, word processing equipment, computers, calculating machines, etc. are small enough in size and weight to be portable and are too expensive for their owner to risk undesired removal, or loss or theft. It has become customary to secure such portable equipment to a fixed surface such as a shelf, desktop, etc., which prevents unauthorized, undesired removal of such equipment. Sometimes, the equipment is directly affixed to the surface, e.g. by being bolted to it. This has the disadvantage that the equipment cannot be moved about on the surface for convenience in storage and use. To permit an article to be moved around at least to a limited extent, it is known to attach the article to the fixed object by means of an elongate cable, long enough to permit the piece of equipment to be moved around. The cable can be a fairly strong metal cable or chain which is difficult to cut. The cable is most vulnerable to separation from the article of equipment at its connection to the article and or at its connection to the fixed surface.

The inventor hereof had devised a system to attach articles of portable equipment to a fixed support by a strong, perhaps armored, cable, and to hide the points of attachment to the equipment, on the one hand, and to the support, on the other hand, so that the cable could not be detached at the points of attachment.

Often, an article is not used singly, but several articles of equipment are used adjacent each or are connected. For example, in a word processing system or a small computer, there are a keyboard and a CRT unit which are separate but are used near each other. There may be other articles associated together. While a single, individual cable may be provided for each article, it is desirable to minimize the number of cables and of attachments that must be made to the fixed support for holding a plurality of articles of equipment in a small area.

SUMMARY OF THE INVENTION

It is the primry object of the present invention to secure a plurality of articles of equipment to a support.

It is another object of the invention to secure the articles so that they may be selectively spaced at variable distances from each other.

According to the invention, a single, strong, hardened, substantially unbreakable, perhaps armored, main cable, chain, or the like is attached to a relatively fixed support, such as the leg or side of the desk, at an attachment at the proximal end of the cable. The other distal end of that cable has an attachment for attaching it to one article of equipment.

For attachment of the cable to other articles of equipment, there are disposed along the main cable one or a plurality of branch or auxiliary cables each of which is individually adjustably positionable along the main cable. This permits adjustments for the positions of the plural articles of equipment in a particular installation. The proximal end of each branch cable is attached to the main cable. For this purpose, the branch cable is attached to an element which encircles the main cable, such as a metal annular washer. The annular element is loose enough on the main cable to rotate freely around the main cable, as well as to freely move along the cable. This adapts to various arrangements of secured articles. The attachment between the proximal end of the auxiliary cable and the annular element is a swivel connection which again enables adaptation to various arrangements of the articles. The distal end of each branch cable also has a respective attachment for attaching it to a respective article of equipment.

Other objects and features of the invention will become apparent from the following description of preferred embodiments of the invention, considered in conjunction with the accompanying drawings.

BRIEF DESCRIPTION OF THE DRAWING FIGURES

FIG. 4 shows one embodiment of the cable in use;

FIG. 5 shows an alternate way of attaching an article to the cable; and

FIG. 6 is a fragmentary view of the underside of the article in FIG. 5.

DESCRIPTION OF A PREFERRED EMBODIMENT

Figure 1:
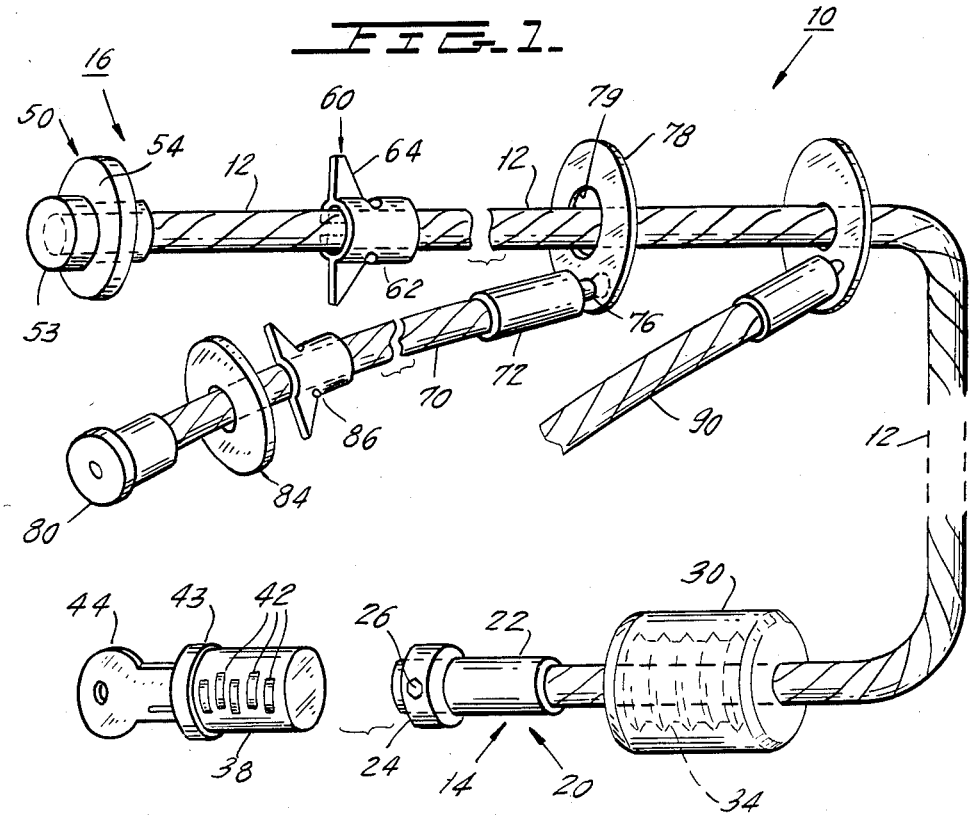
FIG. 1 shows a locking cable according to the invention.
Figure 2:
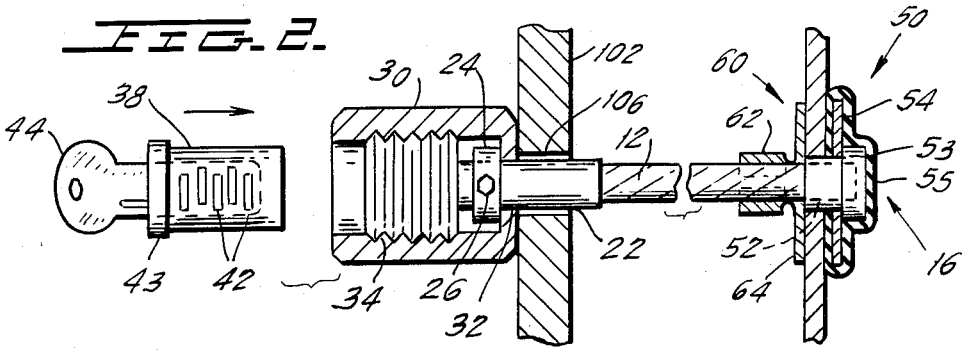
FIG. 2 is a cross sectional view illustrating one stage in the attachment of the cable to a fixed support.
Figure 3:
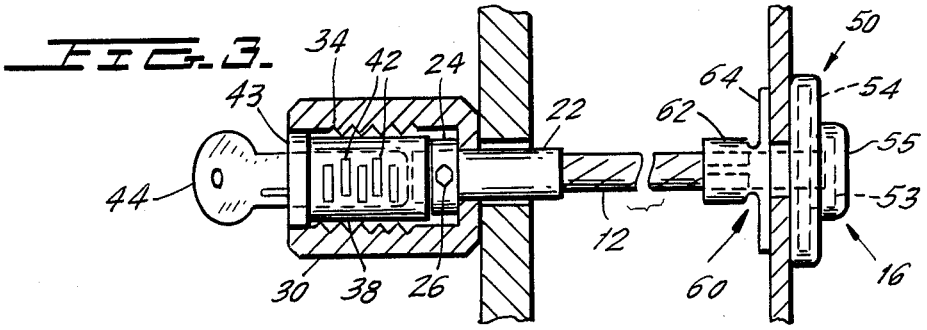
FIG. 3 illustrates a later stage in the attachment.

The cable 10 according to the present invention comprises a main cable 12 of stranded steel wire, which is quite hard and thick enough and strong enough that it is not easily broken by flexing or being cut. It is sufficiently flexible to bend, which permits attachment of the cable to a fixed support, and enables attachment of the main 12 and branching auxiliary cables 70, 90 to respective articles of equipment. The main cable 12 extends from its proximal locking end 14 to its distal attachment end 16 which is attached to one of the articles to be secured.

The end 14 of the cable is fitted with a cable stop 20 which includes a thin tubular sleeve 22 which is permanently fitted over and fixed to the end of the cable. A wider collar 24 snugly, but slidably, fits over the sleeve. A set screw 26, which may be headed to be operated with an Allen wrench or may be grooved for receiving a screwdriver, is supported in a threaded radially directed hole in the collar 24 to project to and to be tightened securely against the sleeve 22 for completing the cable stop 20. As described below, the collar 24 is not applied to the cable sleeve 22 until the cable has been attached to the fixed support 110, described below.

The sleeve 24 can quite easily be removed from the cable by an unauthorized person who simply opens the set screw 26. It is thus necessary to block access to the screw 26 once the cable is installed. To fix the cable stop 20 and protect the screw 26, a cable stop receiving cylinder 30 is disposed on the cable 12. It has an opening into it with a narrowed entrance section 32 which is fitted to snugly and slidingly receive the sleeve 22 of the cable stop 20. Inward of the narrowed section 32 of the opening in the cylinder 30 is the widened main section 34. The cylinder 30 is pulled outward over the sleeve 22 so that the collar 24 lies against the bottom of the section 34 of the cylinder 30.

Then a locking barrel 38 with locking projections 42 along one side and having a diameter about the diameter of the opening into section 34 in cylinder 30 is placed in the cylinder section 34. The widened collar 43 at the end of the barrel 38 covers the open end of the cylinder 30 and sets the maximum extent to which the barrel 38 projects into the section 34. The barrel 38 protects the collar 24 and screw 26 and holds the collar in the opening section 34. The key 44 in the barrel of the lock 38 is selectively rotated to force the projections 42 outwardly, which locks the cylinder 38 in the opening section 34 or is rotated to release the projections 42 from the cylinder wall, permitting removal of the barrel 38 from the opening section 34.

The distal end 16 of the cable 12 is provided with the cable stop 50, which is permanently fixed on the distal end of the cable 12. The stop 50 includes the thin sleeve 52 and the terminating wide collar 53. The sleeve 52 is permanently installed on the end of the cable 12 by soldering or welding. A separate washerlike collar 54 is disposed over the sleeve 52 to rest against the side of the collar 53. As will be described below, the cable is installed with the cable stop 50 hidden inside the article of equipment being secured. The collar 54, disposed on the inside of the shell 106 of the article 100 of equipment being protected, will spread the force of the cable stop 50 over a greater surface area of the shell of the article, reducing the chance of damage to the shell if an attempt is made to pull the cable out of the article. To hold the sleeve 52, 53 and the collar 54 together as one unit, they are surrounded by a covering layer 55 of rubber, plastic or even tape.

A cable crimp element 60 is disposed next to the stop 50. It is placed on the cable 12 after the cable has been secured to the article to be protected. The crimp element has a C-shaped cross-section, with an open side into which the cable is passed. The crimp element is slidable on the cable 12. The crimp element includes the deformable proximal tabs 62 which are to be crimped against the cable. The distal wings 64 of the element 60 are supported against the shell 106 of the article being protected. After the cable stop 50 is inside the shell of the article 100 and the cable extends through an opening 104 in that shell, the cable is taut so that the collar 54 presses against the interior surface of the shell. Then the crimp element 60 is slid to move the wings 64 against the exterior of the shell of that article. Next the tabs 62 are tightened securely on the cable 12. The crimp element holds the cable stop 50 against the inside of the shell. The crimp element need not be secured against removal from the cable, since removal of the crimp element will not permit removal of the cable from the article 100 or from the support 110.

A plurality of auxiliary branching cables 70, 90, etc. are also supported on the main cable 12. Each of the auxiliary cables 70, 90 would have the same construction, whereby a description of only the cable 70 will be a description of the others as well.

At its proximal end, the cable 70 is fixedly attached in the end sleeve 72, e.g. by welding or soldering, so that the cable cannot be removed from that sleeve. That sleeve is, in turn, attached at a firm, but rotation and swivel permitting journal connection 76 in the body of the washer 78. The journal connection may include a ball at the end of the sleeve 72, which is held in a socket defined in the C-washer 78. The journal connection permits the cable 70 to be twisted with respect to the main cable so as to prevent the cable 70 from becoming twisted. The washer 78 has a large central hole 79 so that the washer 78 may tilt with respect to the cable 12, may be rotated around the cable and may easily slide along the cable. This permits the various articles of equipment held by the branching lock cable 10 of the invention to be positioned at various locations with respect to each other and also to be moved to various positions throughout their use. Moving one article of equipment with respect to the others will merely result in the washer 78 sliding along the cable 12. The hole 79 in the washer 78, of course, is smaller than the cable stop collar 54 and the cylinder 30, so that the washer 78 would not move off the ends of the cable 12.

The distal end of the cable 70 remote from the washer 78 may be provided with the same elements as the distal end of the main cable 12, namely, the cable stop 80, washer 84 and crimp element 86. These may be attached to the respective auxiliary cable 70 in the same manner as the cable stop 50.

The auxiliary cable 90 is attached on the cable 12 in the same manner as the auxiliary cable 70, and the auxiliary cable 90 has the other characteristics of the cable 70, whereby the cable 90 is not described in detail. While two auxiliary cables 70 and 90 are illustrated, there is no limit to the number of auxiliary cables that may be provided.

Installation of one of the cables, for example the main cable 12, to an article of equipment 100 to be protected is now described with respect to FIG. 4. Other articles of equipment like 102 may be attached to the auxiliary cables 70, 90 in the same manner. First, a hole 104 is formed through the back wall of the shell 106 of the article 100 to be secured. The hole would be drilled in the location on the shell most appropriate for esthetic reasons, to avoid damage to the internal parts of the equipment and to have the cable stop 50 hidden from view while permitting the article to be moved around. The cable stop 50, 54 is affixed on the cable. The proximal end of the cable 12 is fed from inside the shell 106 through the hole 104. The cable is pushed through the hole 104 until the cable stop 50 is inside the shell, and the washer collar 54 is against the shell. The crimp element 60 is fitted over the cable 12 and is slid against the shell 106 and is crimped on the cable there.

Other articles of equipment 102, etc. may be attached to the auxiliary cables 70 and 90 in the same manner. The washer 78 of the auxiliary cable 70 and corresponding washers of the other auxiliary cables are disposed on the cable 12 from its proximal end.

The cable 12 is now attached to the fixed support 110, illustrated as a large desk. The attachment to the desk 110 is at one of its legs 112. After the cable is attached to the desk leg 112, the articles are thereby secured to the desk, and it is possible to remove the articles only by destruction of the articles, by breaking the chain away or by destroying the desk leg or by moving the entire desk. A hole 116 is formed in the desk leg 112. The proximal end of the cable is passed through the hole 116. The hollow cylinder 30 is slid onto the cable over the sleeve 22. The collar 24 is attached at set screw 26. The cable 12 is moved to move the collar into cylinder 30. Then the lock barrel 38 is applied in the cylinder 30. Although not illustrated, a crimp element like the crimp element 60, may be provided on the side of the leg 112 opposite the side at which the cylinder 30 is disposed for preventing jiggling of the locked end of the cable.

As an alternative to attaching the cable 12, 70, 90 to the article by cutting a hole 104 in shell 106 of the article which damages the shell, FIGS. 4, 5 and 6 illustrates a separate L-shaped attaching bracket 120. This bracket includes an elongate arm 122, which is attached to the body of the article, e.g. to the bottom of the article, by a known quite strong epoxy tape 123 which effectively integrates the taped on bracket arm 122 to the article. An appropriate solvent or prying means will separate the taped on arm 122 from the article. But, this separation will take a long time to accomplish, precluding rapid removal of the protected article, which is the primary benefit of the invention. The bracket 120 includes a second arm 124 which has the respective hole 126 cut into it in which the cable end 16, 52 is disposed and to which that cable end is locked.

Although the present invention has been described in connection with the preferred embodiments thereof, many variations and modifications will now become apparent to those skilled in the art. It is preferred, therefore, that the present invention be limited not by the specific disclosure herein, but only by the appended claims.

What is claimed is:

1. A plural branch locking cable means comprising:

a main cable having a distal end and a proximal end; a cable stop positioned at the distal end of the main cable for being disposed at the distal side of a part of an article to be secured, whereby when the cable is passed through an opening in the part of the article and the cable is moved to move the cable stop against the side of the part of the article facing toward the distal end of the cable, the cable stop thereafter prevents extraction of the cable from the opening in the part of the article;

locking means at the proximal end of the main cable for locking the proximal end of the main cable to a support, whereby the main cable is anchored to the support;

an auxiliary cable having a distal end for attachment to another article and a proximal end for attachment to the main cable; an auxiliary cable stop positioned at the distal end of the auxiliary cable for being disposed at the distal side of a part of an article to be secured, whereby when the auxiliary cable is passed through an opening in the part of the article to be secured by the auxiliary cable and the auxiliary cable is moved to move the auxiliary cable stop against the side of the part of the article facing toward the distal end of the auxiliary cable, the auxiliary cable stop thereafter prevents extraction of the auxiliary cable from the opening in the part of the article;

auxiliary cable attachment means at the proximal end of the auxiliary cable for attaching the proximal end of the auxiliary cable at the main cable and for permitting the position of the proximal end of the auxiliary cable along the main cable to be freely adjustable.

2. The locking cable means of claim 1, further comprising a respective crimp element at at least one of the main and auxiliary cables and disposed at that side of the part of the article being secured by the respective cable which is away from the respective cable stop on that cable; the crimp element is crimpable on the respective cable and also includes means for engaging that side of the part of the article which is opposite the side of the part which is engaged by the respective cable stop for holding the respective cable stop at the panel of the article.

3. The locking cable means of claim 1, wherein the attachment means for the auxiliary cable comprises an annular element around the cable including an opening through the annular element sized to permit the annular element to be freely moved along the main cable, and a connection between the auxiliary cable and the annular element.

4. The locking cable means of claim 3, wherein the connection between the auxiliary cable and the annular element therefor at the main cable comprises a swivel connection, and the annular element also being freely movable to rotate around the main cable.

5. The locking cable means of claim 1, wherein the locking means at the proximal end of the main cable comprises a collar securable to the proximal end of the main cable and securement means for securing the collar to the main cable; and access prevention means for preventing access to the securement means on the collar of the main cable.

6. The locking cable means of claim 5 wherein the access prevention means comprises a hollow cylinder on the main cable and having a hollow into which the collar and the collar securement means may be moved by moving the cable relative to the hollow cylinder, the access prevention means further comprises a barrel shaped to project into the hollow of the hollow cylinder with the collar disposed therein; the barrel including locking means for removably locking the barrel in the cylinder for preventing access to the collar and its securement means in the cylinder.

7. The locking cable means of claim 1, further comprising at least one bracket for at least one of the main and auxilliary cables, the bracket being securable to an article to be attached to the respective cable; the bracket including a section thereof to be attached to the article and including an additional section thereof in which a hole is provided, and that additional section of the bracket serves as the part of the article to which the respective cable is secured; through the opening in the additional section of the bracket the respective cable extends, and the cable stop of the respective cable being at one side of the additional section of the bracket which is at the distal end of the respective cable, while the cable extends through the opening in the additional section and toward the proximal end of the respective cable.

* * * * *